US008132906B2

(12) United States Patent
Tomita

(10) Patent No.: US 8,132,906 B2
(45) Date of Patent: Mar. 13, 2012

(54) PRINTER

(75) Inventor: Katsuo Tomita, Tokyo (JP)

(73) Assignee: Kabushiki Kaisha Sato (JP)

( * ) Notice: Subject to any disclaimer, the term of this patent is extended or adjusted under 35 U.S.C. 154(b) by 422 days.

(21) Appl. No.: 12/524,062

(22) PCT Filed: Dec. 27, 2007

(86) PCT No.: PCT/JP2007/075072

§ 371 (c)(1),
(2), (4) Date: Jul. 22, 2009

(87) PCT Pub. No.: WO2008/090713

PCT Pub. Date: Jul. 31, 2008

(65) Prior Publication Data

US 2009/0315964 A1 Dec. 24, 2009

(30) Foreign Application Priority Data

Jan. 22, 2007 (JP) ..... 2007-011971

(51) Int. Cl.
*B41J 2/01* (2006.01)
*B41J 25/304* (2006.01)
*B41J 2/315* (2006.01)

(52) U.S. Cl. ..... 347/104; 347/197; 400/120.16

(58) Field of Classification Search ..... 347/104, 347/197; 400/120.16
See application file for complete search history.

(56) References Cited

U.S. PATENT DOCUMENTS 5,133,611 A * 7/1992 Nakajima ..... 400/120.16

FOREIGN PATENT DOCUMENTS

| | | |
|---|---|---|
| JP | 46460/1993 | 6/1993 |
| JP | 2003-48335 | 2/2003 |
| JP | 2005-324374 A | 11/2005 |

OTHER PUBLICATIONS

International Search Report dated Apr. 1, 2008, issued in corresponding international application No. PCT/JP2007/075072.

* cited by examiner

*Primary Examiner* — Stephen Meier
*Assistant Examiner* — Tracey McMillion
(74) *Attorney, Agent, or Firm* — Ostrolenk Faber LLP

(57) ABSTRACT

A printer which enables both of position adjustment and attachment/detachment of a printing head. The printer includes: a platen roller, an opposing printing head; a first head support member capable of rotating relative to a casing; a first shaft as a rotary axis of the first head support member; a second shaft attached to the first head support member and including a large diameter portion and a small diameter portion each having a different central axis to the rotary axis; and a second head support member, to which the printing head is attached, and which is formed with a first set of grooves into which the first shaft is inserted and a second set of grooves into which the second shaft is inserted; the second head support member moves in accordance with rotation of the second shaft, when attached to the first head support member, due to engagement between the first set of grooves and the first shaft and engagement between the second set of grooves and the small diameter portion of the second shaft, and can be removed from the first head support member by moving the second shaft parallel to the axial direction.

4 Claims, 10 Drawing Sheets

355

PRINTER

CROSS REFERENCE TO RELATED APPLICATION

The present application is a 35 U.S.C. §§371 national phase conversion of PCT/JP2007/075072, filed Dec. 27, 2007, which claims priority of Japanese Application No. 2007-011971, filed Jan. 22, 2007, the disclosure of which is incorporated by reference herein. The PCT International Application was published in the Japanese language.

BACKGROUND OF THE INVENTION

1. Field of the Invention

The present invention relates to a printer, such as a label printer, for conveying a label continuous body in which labels are temporarily adhered to a backing sheet and performing printing on the labels.

2. Description of the Related Art

In a label printer, a label continuous body (also referred to hereafter as a "sheet") in which labels of a predetermined length are temporarily adhered to an elongated strip-form backing sheet (separator) at constant intervals is used as a printing medium, for example. The sheet is conveyed by a platen roller, and printing is performed on the labels using a heat generator of a thermal head provided on the opposite side of the sheet to the platen roller.

When the relative positions of the heat generator of the thermal head and the platen roller are different at this time, the printing quality deteriorates. Hence, the relative positions of the platen roller and the thermal head must be aligned accurately. Further, the thermal head is an expendable item, and therefore, the thermal head must be replaced when a part of the heat generator breaks down due to a disconnection or the like.

However, in a conventional label printer, a front-rear position of the thermal head (the front and rear of a parallel direction to a conveyance direction of the sheet) is adjusted by an operator by fixing the thermal head using left and right screws while viewing a printing sample, and therefore the adjustment operation takes time and leads to large irregularities and the like according to the operator. Moreover, to replace the thermal head, the left and right screws must be loosened, and therefore front-rear position adjustment must be performed again after the thermal head is replaced.

As related art, Japanese Unexamined Patent Application Publication 2003-48335 (Page 1, FIG. 1) discloses a head attachment/detachment mechanism in which an expendable thermal head can be attached and detached easily in a thermal printer in order to replace the head. In this head attachment/detachment mechanism, a rotatable attachment/detachment lever is disposed on a head substrate side, and by rotating the attachment/detachment lever, a part of a head support plate is pressed such that the head substrate side slips out from the head support plate side against the frictional resistance of a fitting portion between a connector on the head support plate side and a connector on the head substrate side. Thus, the thermal head can be attached and detached through a simple operation to rotate the attachment/detachment lever.

According to Japanese Unexamined Patent Application Publication 2003-48335, however, a head position adjustment mechanism must be provided separately to the head attachment/detachment mechanism to adjust the position of the head, and therefore the peripheral mechanisms of the head become complicated.

SUMMARY OF THE INVENTION

In consideration of the points described above, an object of the present invention is to provide a printer with which both position adjustment and attachment/detachment of a printing head can be performed easily.

To solve the problems described above, a printer according to one aspect of the present invention includes: a platen roller that conveys a printing medium when driven to rotate by a motor provided in a casing; a printing head that performs printing on the printing medium when the printing medium is sandwiched between the printing head and the platen roller; a first head support member capable of rotating relative to the casing; a first shaft serving as a rotary axis of the first head support member; a second shaft that is attached to the first head support member to be capable of rotating and moving parallel to an axial direction, and includes a large diameter portion having a comparatively large radius and a small diameter portion having a smaller radius than the large diameter portion and a different central axis to the rotary axis; and a second head support member, to which the printing head is attached, and which is formed with a first set of grooves into which the first shaft is inserted and a second set of grooves into which the second shaft is inserted, moves in accordance with rotation of the second shaft, when attached to the first head support member, due to engagement between the first set of grooves and the first shaft and engagement between the second set of grooves and the small diameter portion of the second shaft, and can be removed from the first head support member by moving the second shaft parallel to the axial direction.

According to the present invention, the position of the printing head can be adjusted by rotating the second shaft, and the printing head can be attached and detached by moving the second shaft parallel to the axial direction, and therefore both position adjustment and attachment/detachment of the printing head can be performed easily.

DESCRIPTION OF THE PREFERRED EMBODIMENTS

An embodiment of the present invention will be described in detail below with reference to the drawings. Note that identical reference symbols have been allocated to identical constitutional elements, and description thereof has been omitted.

The present invention may be applied to a typical printer, but in the following embodiment, a case in which the present invention is applied to a label affixer for performing printing on a label and affixing the printed label to an affixing subject body such as cardboard will be described.

Figure 1:
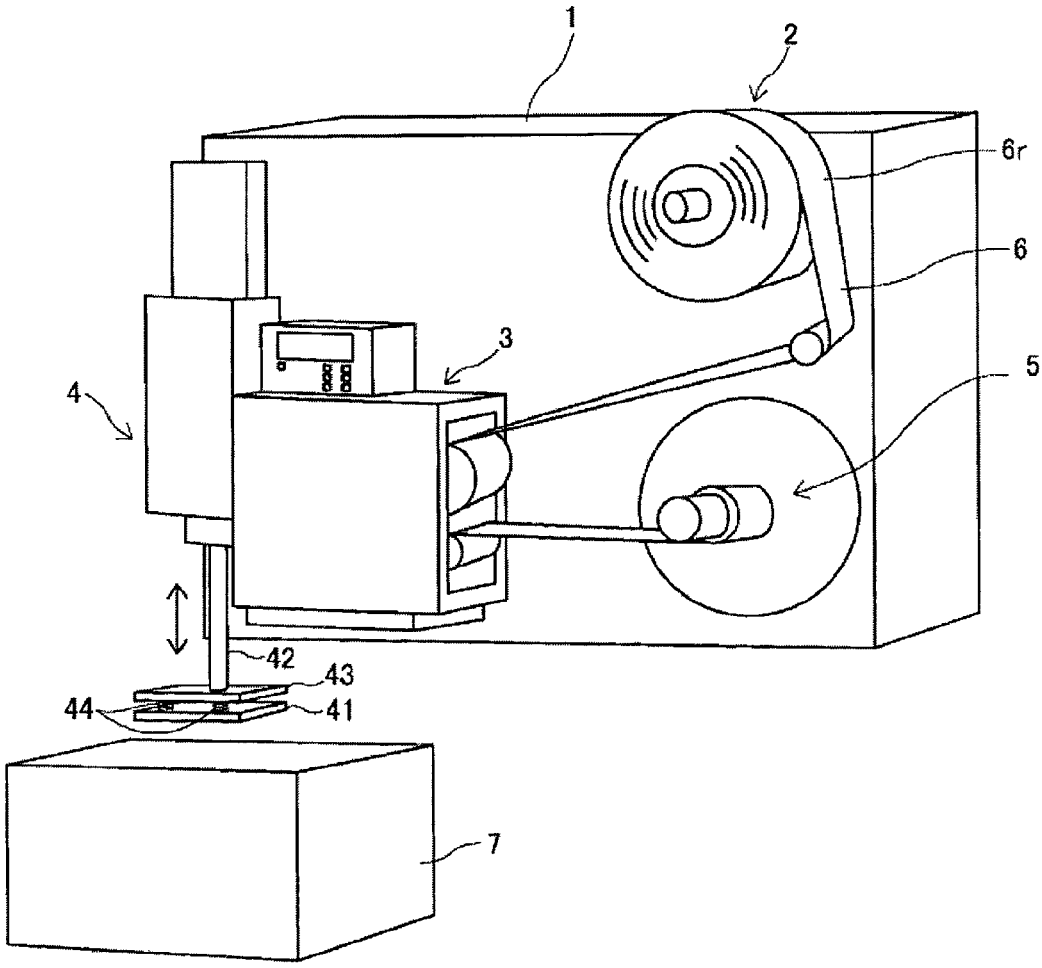
FIG. 1 is a perspective view showing in pattern form a label affixer according to an embodiment of the present invention.

FIG. 1 is a perspective view showing in pattern form a label affixer according to an embodiment of the present invention. As shown in FIG. 1, the label affixer includes a casing 1, a sheet supply unit 2 for supplying a sheet 6 by rotatably holding a rolled sheet 6*r* formed by winding a label continuous body (sheet) in which labels are temporarily adhered to a backing sheet into a roll shape, a printing unit 3 for performing printing onto the label part of the sheet 6 supplied by the sheet supply unit 2, an affixing unit 4 for affixing a label that has been peeled away from the backing sheet following printing to an affixing subject body such as cardboard 7, and a backing sheet winding unit 5 for winding the backing sheet from which the label has been peeled.

The affixing unit 4 is provided with a suction plate 41 for aspirating a label that has been peeled away from the backing sheet by negatively pressurizing air, and an air cylinder 42 for moving the suction plate 41 between a suction position in which the suction plate 41 aspirates the label and an affixing position in which the label is brought into contact with and affixed to the cardboard 7 serving as the affixing subject body. Note that the suction plate 41 is provided on the opposite side of a spring 44 to a base 43 so that shock generated when the suction plate 41 contacts the affixing subject body via the label can be absorbed and an impact on the affixing unit 4 and the affixing subject body can be alleviated.

Figure 2:
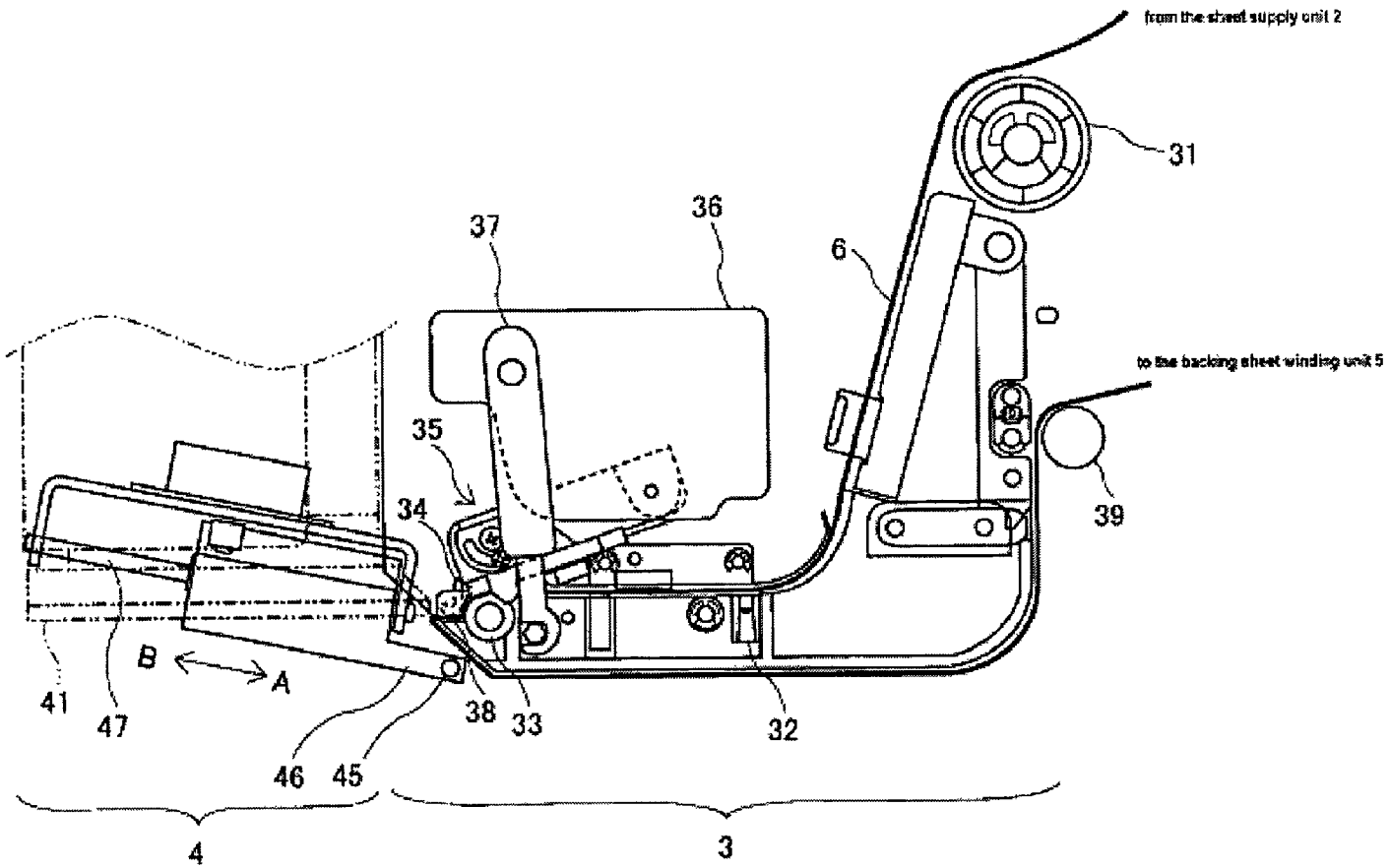
FIG. 2 is a partial sectional view showing the structure of a printing unit and an affixing unit of the label affixer shown in FIG. 1.

FIG. 2 is a partial sectional view showing the structure of the printing unit and the affixing unit of the label affixer shown in FIG. 1. As shown in FIG. 2, the printing unit 3 includes a guide roller 31 for guiding the sheet 6 supplied by the supply unit 2, a label sensor 32 for detecting the position of a label on the sheet 6 inserted into the printing unit 3, a platen roller 33 that is driven to rotate by a stepping motor via a gear or a belt in order to convey the sheet 6, a thermal head 34 that opposes the platen roller 33 via the sheet 6 and performs printing onto the label, a head support 35 for supporting the thermal head 34, a head support frame 36 to which the head support 35 is attached rotatably, a head opening/closing lever 37 for opening and closing the head support 35 relative to the platen roller 33, a label peeling member 38 for peeling the label from the backing sheet, and a roller 39 for leading the backing sheet to the backing sheet winding unit 5.

The thermal head 34 includes a collection of minute heat generators that generate heat when a current is caused to flow through the heat generators. When printing is performed onto the label, a voltage is applied to the heat generators while the sheet is sandwiched between the platen roller 33 and the thermal head 34, causing a current to flow through the heat generators such that the heat generators generate heat. Printing is then performed onto the label by subjecting a thermal color development layer provided on the surface of the label to color development.

Rotation of the platen roller 33 and backing sheet winding unit 5 is controlled on the basis of the label position detected by the label sensor 32. When the platen roller 33 and the backing sheet winding unit 5 are rotated by a plurality of stepping motors, not shown in the drawing, the sheet 6 is conveyed from the supply unit 2 to the printing unit 3. Printing is then performed on the label by the thermal head 34, whereupon the backing sheet is wound by the backing sheet winding unit 5.

The sheet 6 conveyed by the platen roller 33 and the backing sheet winding unit 5 is folded back by a tip end of the label peeling member 38 so as to bend greatly, and therefore, when the sheet 6 passes the bent portion, the label is peeled away from the backing sheet. The affixing unit 4 includes an air blasting pipe 45 in the suction position of the suction plate 41 to assist suction of the label by the suction plate 41. The air blasting pipe 45 includes a pipe main body having a parallel axis to an edge direction of the label peeling member 38, and a plurality of blasting holes for blasting air in the axial direction are formed in the pipe main body. The air blasting pipe 45 is positioned near the edge of the label peeling member 38 and on the outer side of the folded backing sheet in order to blast air toward the suction plate 41 side from the rear side (affixing surface side) of the label peeled away by the label peeling member 38. By blasting air from the rear side of the label in a direction heading toward the suction plate 41 side, the air blasting pipe 45 prevents the label peeled away by the label peeling member 38 from sagging downward due to gravity, and therefore assists in ensuring that the suction plate 41 aspirates the label securely.

The air blasting pipe 45 is provided on a support member extending from the casing so as to be capable of moving between two positions, namely a blasting position A for blasting air in a position near the edge of the label peeling member 38 and a removed position B removed from the label peeling member 38. One end of the air blasting pipe 45 is held by a holding body 46. The holding body 46 is formed with a sliding hole having an axis that aligns with the movement direction, and a guide shaft 47 is provided in the support member via an attachment member. By inserting the guide shaft 47 into the sliding hole such that the sliding hole is free to slide, the holding body 46 is supported to be free to slide relative to the guide shaft 47, and as a result, the air blasting pipe 45 is supported movably on the supporting member. Further, an angle of incline of the guide shaft 47 is determined such that the air blasting pipe 45 can advance and retreat in a direction that intersects a suction surface of the suction plate 41 at an incline.

Further, the removed position B of the air blasting pipe 45 is set in the vicinity of the suction surface of the suction plate 41 such that when the backing sheet is mounted, the air blasting pipe 45 is positioned on the outside of a label temporary adhesion-side surface of the backing sheet projecting from the label peeling member 38. By moving the air blasting pipe 45 to the removed position B, an operation space for laying the sheet 6 over the label peeling member 38 can be secured, and therefore an operation for replacing the sheet 6 can be performed easily. Further, a pair of feed rollers, not shown in the drawing, may be provided in opposing positions on either side of the sheet 6 on a downstream side of the conveyance direction near the label sensor 32 such that automatic control can be performed to rotate the feed rollers by a predetermined amount and move the air blasting pipe 45 to the removed position B when the tip end of the sheet 6 is detected by the label sensor 32 during sheet setting.

The label peeled away by the label peeling member 38 is guided to the suction plate 41 side by air that is blasted onto the lower side of the label by the air blasting pipe 45, and as a result, the label is aspirated by the suction plate 41. The suction plate 41 is moved to an affixing position by the air cylinder 42, whereupon the suction plate 41 is brought into contact with the affixing subject body via the label such that the label is affixed to the affixing subject body.

Figure 3A:
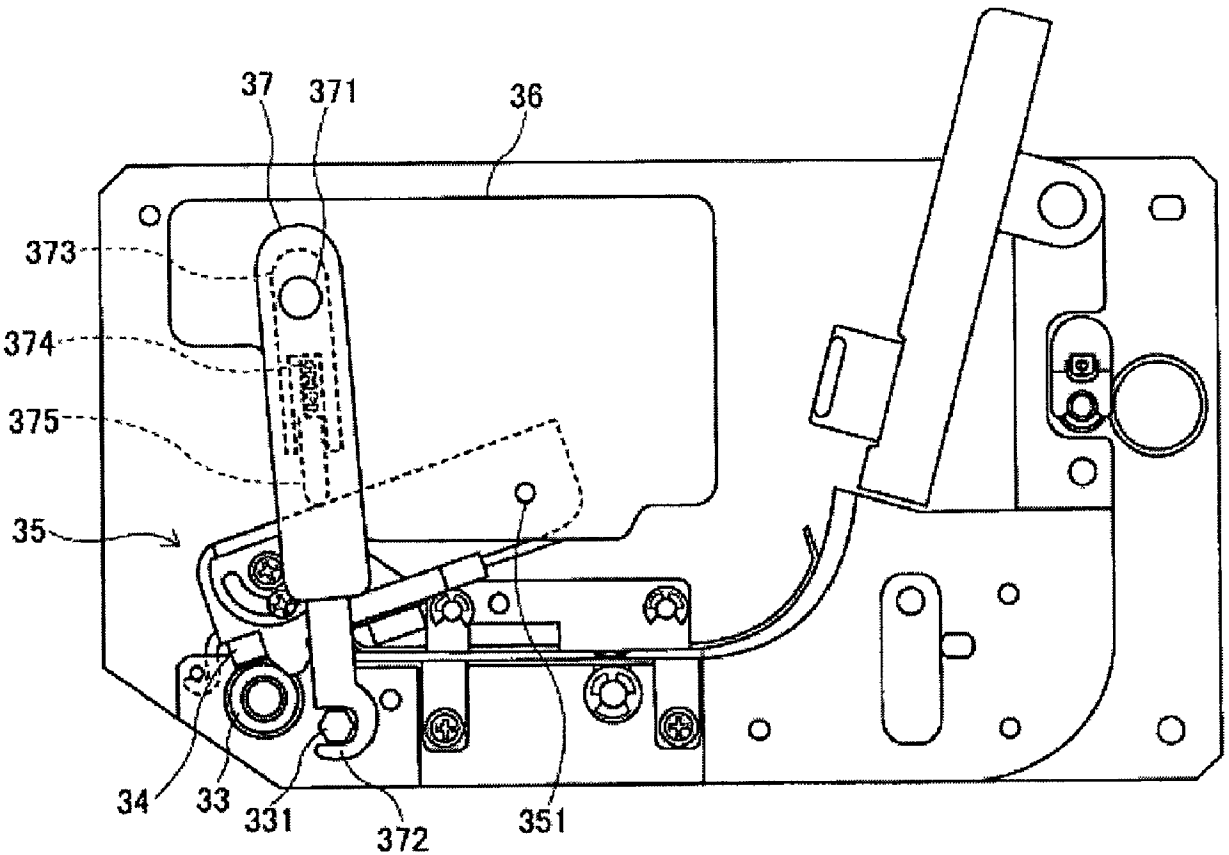
FIG. 3 is a side view showing an opening/closing operation performed on a head support shown in FIG. 2.

FIG. 3 is a side view showing an opening/closing operation performed on the head support shown in FIG. 2. The head support 35 is attached to the head support frame 36, which is fixed to the casing of the label affixer, to be capable of rotating about a head support shaft 351, and the head opening/closing lever is attached to the head support frame 36 to be capable of rotating about a lever shaft 371. Further, a cam holder 373 that rotates in conjunction with the head opening/closing lever 37 is attached to the lever shaft 371. A recess portion is formed in the cam holder 373, and a coil spring 374 and a cam 375 are inserted into the recess portion. The cam holder 373, coil spring 374, and cam 375 constitute a cam mechanism for positioning the head support 35.

Figure 3B:
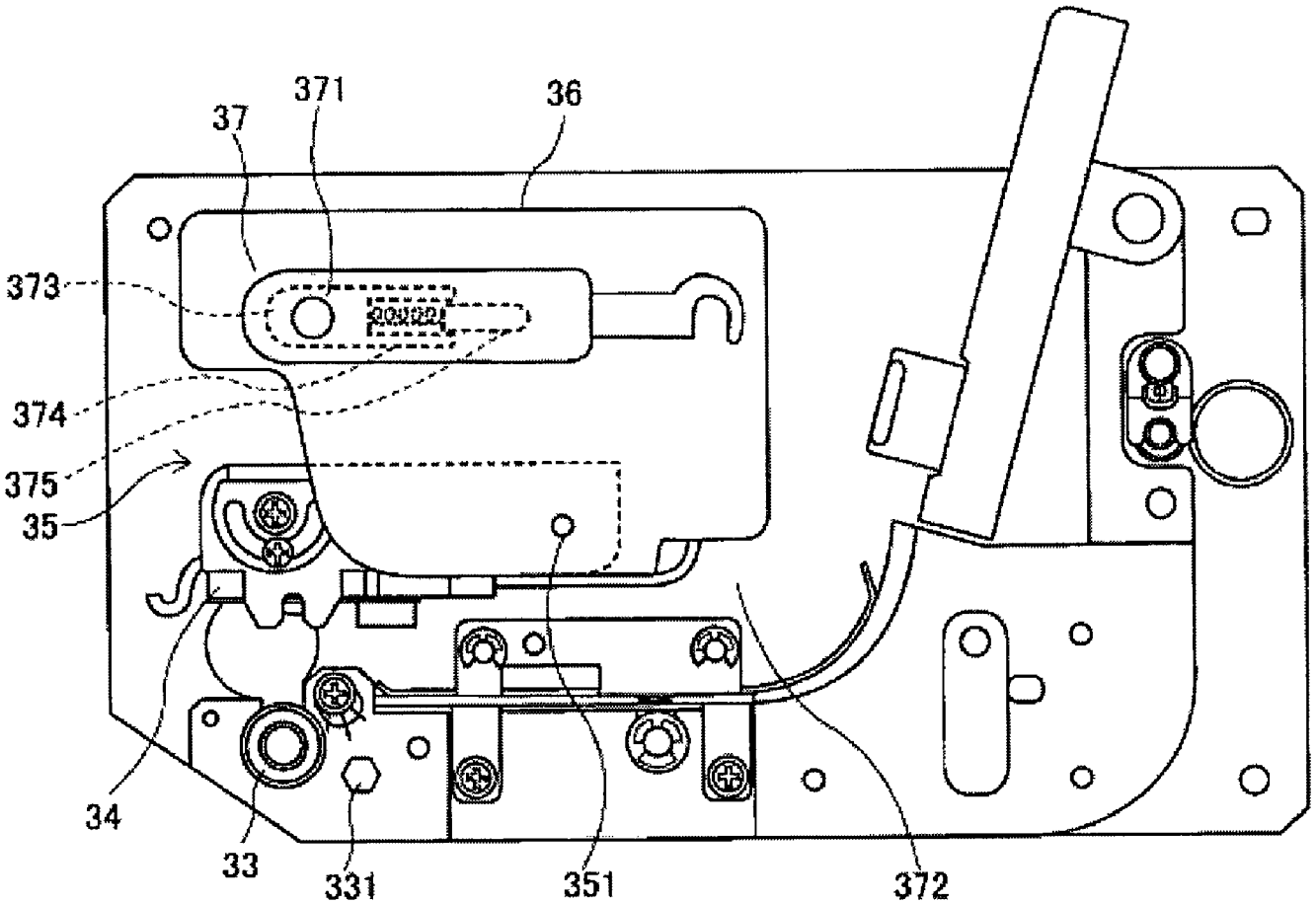
Figure 4:
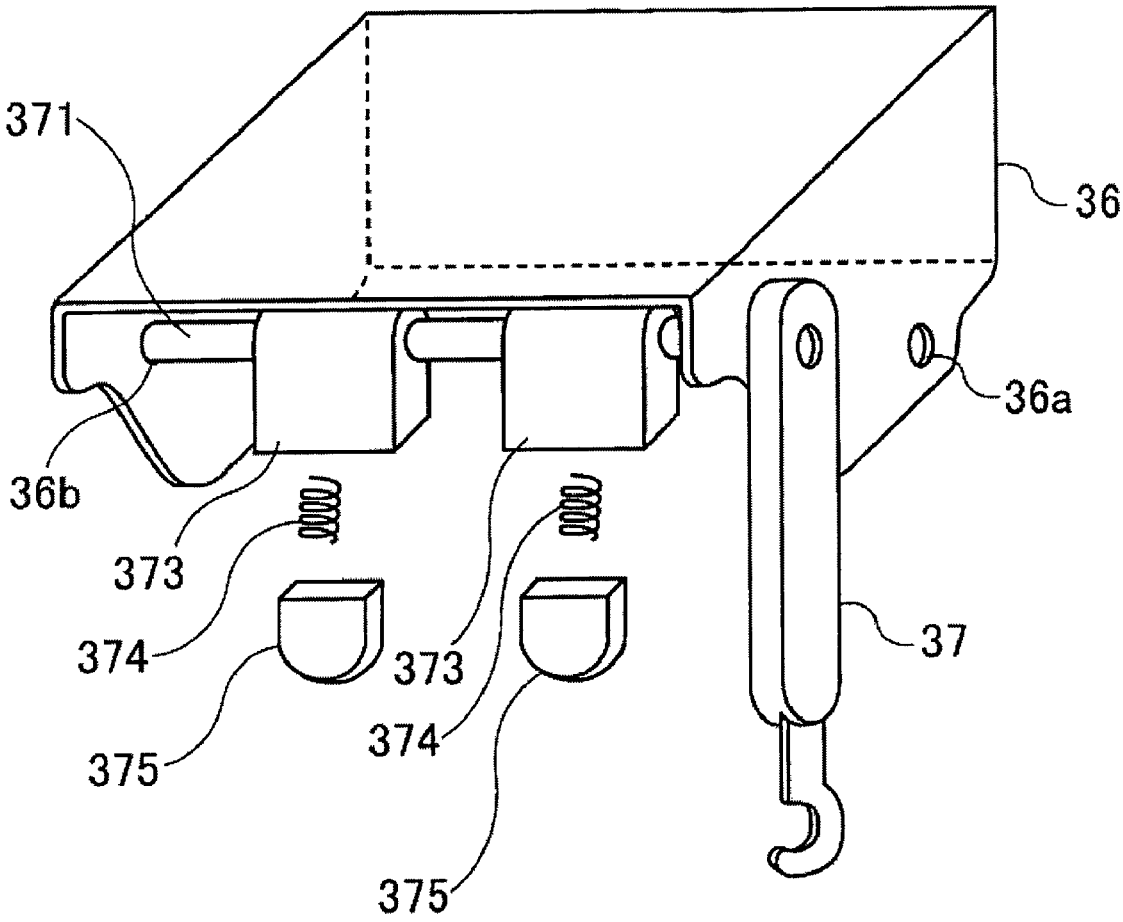
FIG. 4 is a perspective view showing a head opening/closing lever and a cam mechanism shown in FIG. 3.

FIG. 4 is a perspective view showing the head opening/closing lever and cam mechanism shown in FIG. 3. As shown in FIG. 4, the head support frame 36 is formed with a set of shaft holes 36*a* into which the head support shaft 351 (FIG. 3) is inserted, and a set of shaft holes 36*b* into which the lever shaft 371 is inserted. Two cam holders 373 are attached to the lever shaft 371, and the coil spring 374 and cam 375 are inserted into the recess portion in each cam holder 373. The cam 375 is provided to be capable of sliding within the recess portion in the cam holder 373, and the cam 375 is held by a biasing force of the coil spring 374 so that it does not fly out of the recess portion in the cam holder 373.

Referring back to FIG. 3, FIG. 3A shows a state in which the head support 35 is closed and the thermal head 34 is pressed against the platen roller 33 side. A hook 372 provided on the tip end of the head opening/closing lever 37 is locked onto a fixed shaft 331 provided in the vicinity of the platen roller 33. The cam 375 biases the head support 35 to the platen roller 33 side using an expansion force of the coil spring 374.

FIG. 3B shows a state in which the head support 35 is open such that the thermal head 34 is removed from the platen roller 33 side. When an operator rotates the head opening/closing lever 37 in a counter-clockwise direction of the drawing from the state shown in FIG. 3A, the cam holder 373 rotates in conjunction with the head opening/closing lever 37, thereby releasing the pressing contact of the cam 375, and as a result, the head support 35 rotates upward due to an action of a separating spring 353 to be described below such that the thermal head 34 separates from the platen roller 33. In this state, the thermal head 34 can be replaced easily by removing a part of the head support 35.

FIG. 5 is an exploded perspective view showing a head support mechanism for supporting the thermal head. The head support 35 shown in FIG. 3 is attached rotatably to the head support frame 36 shown in FIG. 5A. The head support 35 is constituted by the head support shaft 351 shown in FIG. 5B, a head support upper portion (first head support member) 352 and a set of separating springs 353 shown in FIG. 5C, a head support lower portion (second head support member) 354 shown in FIG. 5D, an eccentric shaft 355 shown in FIG. 5E, and so on.

Figure 5A:
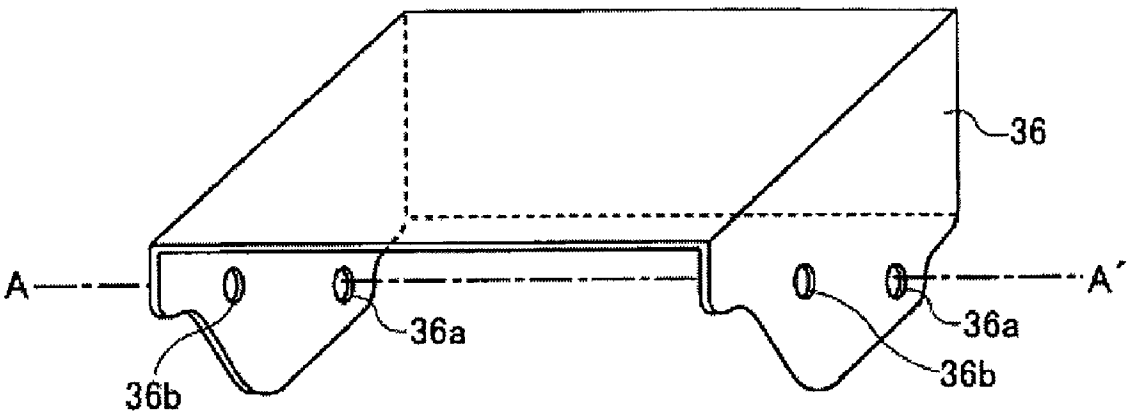
FIG. 5 is an exploded perspective view showing a head support mechanism for supporting a thermal head.
Figure 5B:
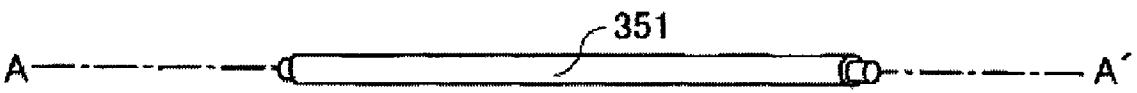
Figure 5C:
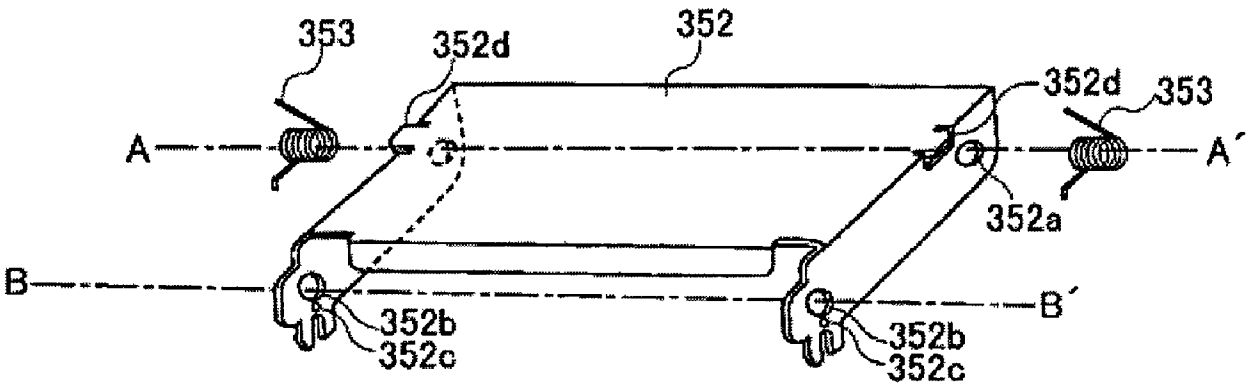

As shown in FIG. 5C, the head support upper portion 352 is formed with a set of shaft holes (elongated holes) 352*a* into which the head support shaft 351 is inserted, a set of shaft holes 352*b* into which the eccentric shaft 355 is inserted, a set of screw holes 352*c*, and an engaging piece 352*d* that engages with one end of the separating spring 353.

The head support upper portion 352 is attached to the inner side of the head support frame 36 by the head support shaft 351, and is capable of rotating relative to the head support frame 36 about the head support shaft 351. The set of separating springs 353 is inserted into the head support shaft 351 between the head support upper portion 352 and the head support frame 36. One end of the separating spring 353 engages with the engaging piece 352*d* of the head support upper portion 352 while the other end of the separating spring 353 is fixed to the casing, and therefore force oriented away from the platen roller (upward) is applied to the head support upper portion 352.

Figure 5D:
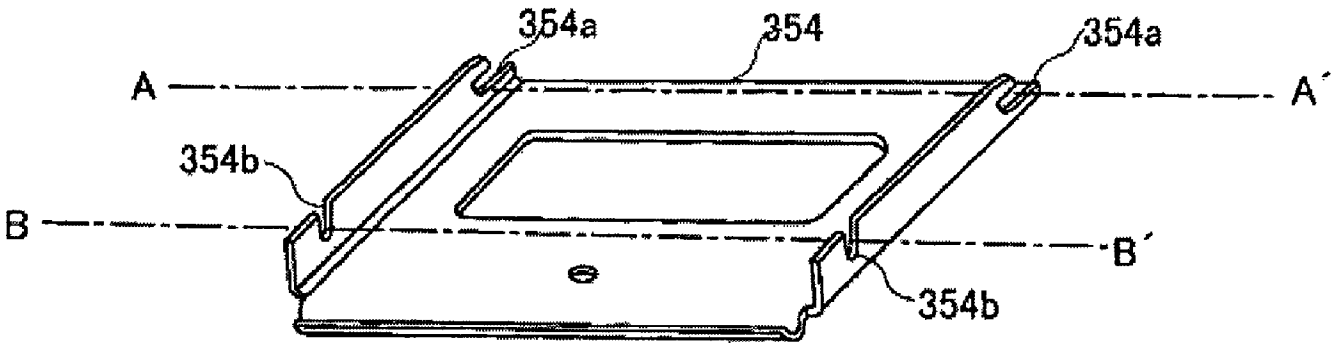

As shown in FIG. 5D, the head support lower portion 354 is formed with a set of grooves 354*a* into which the head support shaft 351 is inserted, and a set of grooves 354*b* into which the eccentric shaft 355 is inserted. The thermal head 34 shown in FIG. 5F is attached to the head support lower portion 354 by a screw.

Figure 5E:
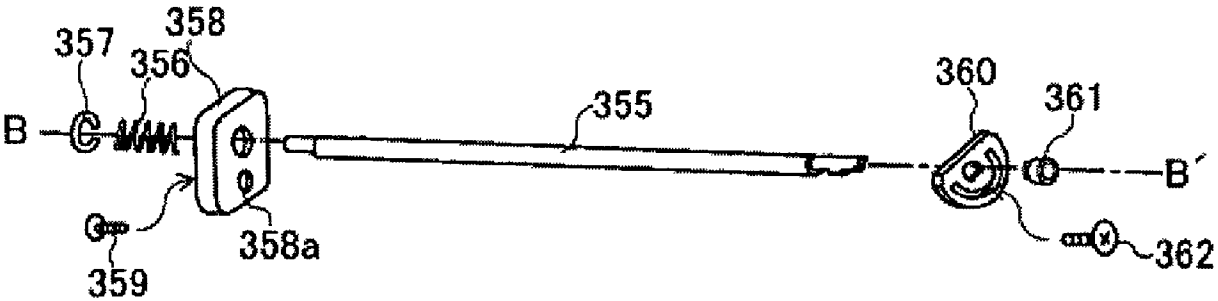
Figure 5F:
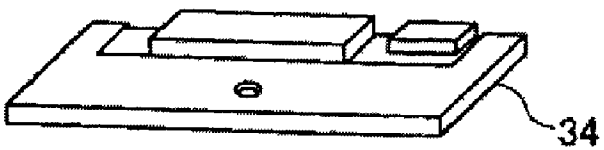

The eccentric shaft 355 shown in FIG. 5E is inserted into the set of shaft holes 352*b* formed in the head support upper portion 352. One end of the eccentric shaft 355 is supported rotatably by a bearing member 358. A coil spring 356 is inserted into this end, and a ring 357 is fixed to the end. The bearing member 358 is fixed to the head support upper portion 352 by inserting a screw 359 into a screw hole 352*c* formed in the head support upper portion 352 via a screw hole 358*a*.

A fixing plate 360 and an adjustment knob 361 are attached to the other end of the eccentric shaft 355. The eccentric shaft 355 is capable of rotating relative to the head support upper portion 352 and moving parallel to an axial direction, and is biased to the left side of the drawing by the expansion force of the coil spring 356. By pulling the adjustment knob 361, the eccentric shaft 355 can be moved to the right side of the drawing.

The adjustment knob 361 rotates together with the eccentric shaft 355 and is used to adjust the position of the thermal head 34 relative to the platen roller. The fixing plate 360 rotates together with the eccentric shaft 355 and is used to fix the position of the thermal head 34 by inserting a screw 362 into the screw hole 352*c* formed in the head support upper portion 352 via a U-shaped hole formed in the fixing plate 360.

In FIGS. 5A to 5D, the position of the head support shaft 351 following assembly of the head support mechanism is indicated by a dot-dash line A-A'. Further, in FIGS. 5C to 5E, the position of the eccentric shaft 355 following assembly of the head support mechanism is indicated by a dot-dash line B-B'. When the head support lower portion 354 is attached to the inside of the head support upper portion 352, the grooves 354*a* in the head support lower portion 354 engage with the head support shaft 351 and the grooves 354*b* in the head support lower portion 354 engage with the eccentric shaft 355.

Figure 6A:
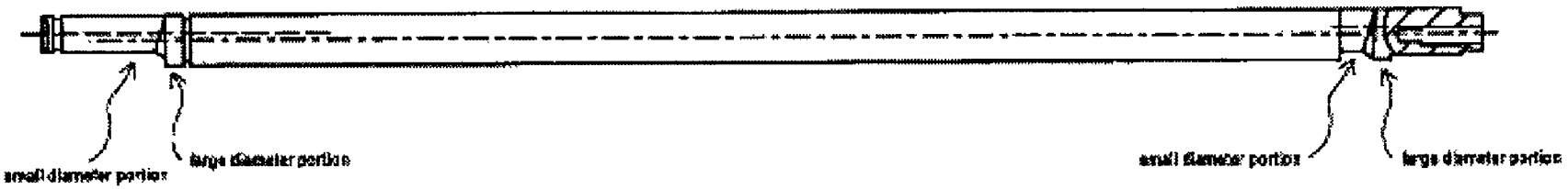
FIG. 6 is a view showing in detail the shape of an eccentric shaft shown in FIG. 5E.
Figure 6B:
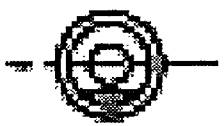

FIG. 6 is a view showing in detail the shape of the eccentric shaft shown in FIG. 5E. FIG. 6A is a front view thereof, and FIG. 6B is a side view thereof. As shown in FIG. 6, the eccentric shaft 355 includes a large diameter portion having a comparatively large radius and a small diameter portion having a smaller radius than the large diameter portion. The respective central axes of the large diameter portion and the small diameter portion are different.

Figure 7A:
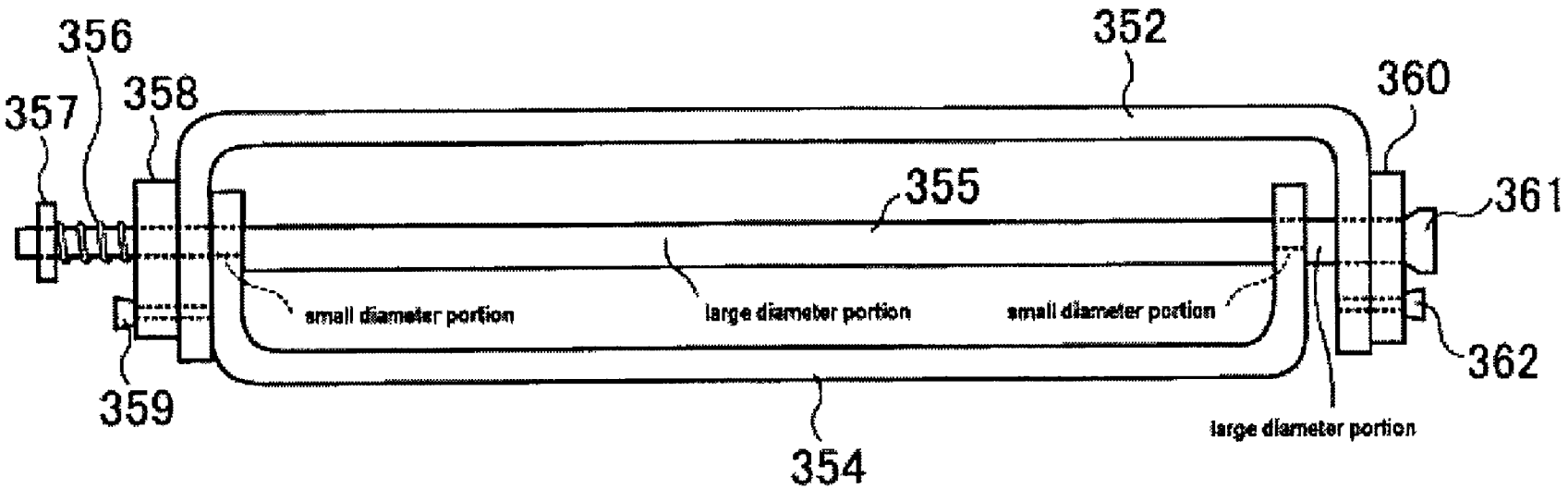
FIG. 7 is a view showing a state in which the eccentric shaft is inserted into a head support upper portion.
Figure 7B:
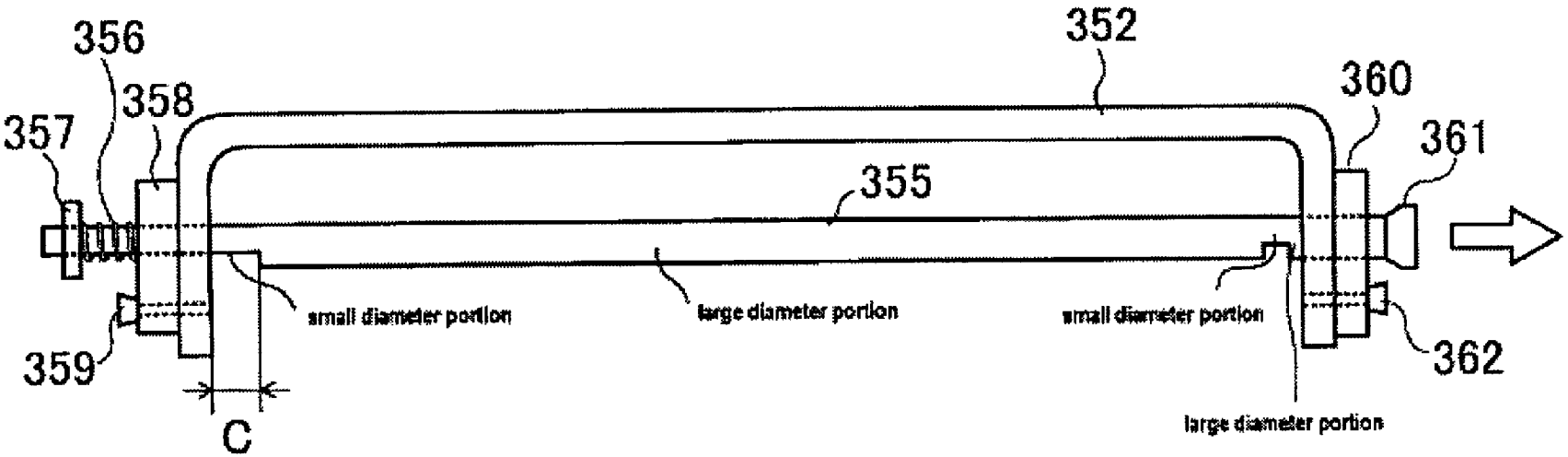

FIG. 7 is a view showing a state in which the eccentric shaft is inserted into the head support upper portion, FIG. 7A showing a state in which the head support lower portion and the head support upper portion are attached, and FIG. 7B showing a state in which the head support lower portion is removed from the head support upper portion 352.

As shown in FIG. 7A, the eccentric shaft 355 is biased to the left side of the drawing by the coil spring 356. The head support upper portion 352 contacts the small diameter portion (left side of the drawing) and the large diameter portion (right side of the drawing) of the eccentric shaft 355 by the set of shaft holes 352*b* (FIG. 5C), while the head support lower portion 354 contacts the small diameter portion of the eccentric shaft 355 by the set of grooves 354*b* (FIG. 5D).

To adjust the position of the thermal head 34, the operator loosens the screw 362 and turns the adjustment knob 361 to rotate the eccentric shaft 355, whereby the eccentric shaft 355 rotates about the central axis of the small diameter portion (left side of the drawing) and the central axis of the large diameter portion (right side of the drawing). When the eccentric shaft 355 rotates, the head support lower portion 354 slides in a front-rear direction relative to the head support upper portion 352 due to the offset between the large diameter portion and the small diameter portion, and thus the front-rear position of the thermal head 34 can be adjusted. The operator then tightens the screw 362 such that the angle of the eccentric shaft 355 is fixed by the fixing plate 360, thereby fixing the position of the thermal head 34.

To replace the thermal head 34, the operator pulls the adjustment knob 361 to increase a distance C between the head support upper portion 352 and the large diameter portion (the left side of the drawing) of the eccentric shaft 355, as shown in FIG. 7B. When the operator moves the head support lower portion 354 towards him/herself from this state, the grooves 354*a* (FIG. 5D) in the head support lower portion 354 are separated from the head support shaft 351, and as a result, the head support lower portion 354 can be removed from the head support upper portion 352. Thus, the thermal head 34 can be replaced easily.

What is claimed is:

1. A printer comprising:

a casing;

a platen roller; a motor that drives said platen roller to rotate; said platen roller is configured and operable to convey a printing medium when said platen roller is driven to rotate by said motor;

a printing head opposing said platen roller, said printing head prints on the printing medium when the printing medium is sandwiched between said printing head and said platen roller;

a first head support member configured and operable to rotate relative to said casing;

a first shaft serving as a rotary axis of said first head support member;

a second shaft attached to said first head support member and said second shaft is rotatable and movable parallel to an axial direction of said second shaft, said second shaft includes a large diameter portion having a comparatively large radius and a small diameter portion having a smaller radius than said large diameter portion and having a different central axis to said rotary axis; and a second head support member, to which said printing head is attached, said second head support member includes a first set of grooves into which said first shaft is inserted and a second set of grooves into which said second shaft is inserted and said second head support member is configured to move in accordance with rotation of said second shaft, when said second shaft is attached to said first head support member, due to engagement between said first set of grooves and said first shaft and engagement between said second set of grooves and said small diameter portion of said second shaft; and said second head support member is configured to be removed from said first head support member by moving said second shaft parallel to said axial direction.

2. The printer according to claim 1, further comprising an adjustment knob that rotates together with said second shaft and is configured and operable to adjust a position of said printing head relative to said platen roller.

3. The printer according to claim 1, further comprising a fixing plate that rotates together with said second shaft and is configured to fix said position of said printing head relative to said platen roller.

4. The printer according to claim 1, further comprising:

a support frame fixed to said casing and to which said first head support member is rotatably attached; and a head opening/closing lever that is rotatably attached to said support frame and is configured and operable to bias said first head support member to said platen roller side or to separate said first head support member from said platen roller side.

* * * * *